United States Patent [19]

Entenmann et al.

[11] Patent Number: 5,046,470

[45] **Date of Patent: * Sep. 10, 1991**

[54] METHOD OF AND DEVICE FOR MONITORING COMBUSTION IN A SPARK IGNITION INTERNAL COMBUSTION ENGINE

[75] Inventors: Robert Entenmann, Benningen; Karl-Heinz Kugler, Vaihingen; Siegfried Rhode, Oberriexingen; Ulrich Rothaar, Stuttgart; Bernhard Stengel, Tamm; Oskar Torno; Stefan Unland, both of Schwieberdingen; Matthias Philipp, Stuttgart, all of Fed. Rep. of Germany

[73] Assignee: RobertBosch GmbH, Stuttgart, Fed. Rep. of Germany

[ * ] Notice: The portion of the term of this patent subsequent to Apr. 17, 2007 has been disclaimed.

[21] Appl. No.: 449,897

[22] PCT Filed: Apr. 2, 1988

[86] PCT No.: PCT/EP88/00277

§ 371 Date: Dec. 4, 1989

§ 102(e) Date: Dec. 4, 1989

[87] PCT Pub. No.: WO89/09333

PCT Pub. Date: Oct. 5, 1989

[51] Int. Cl.[5] ..... F02D 41/26; F02D 41/14; F02P 17/00

[52] U.S. Cl. ..... 123/481; 123/630; 324/388; 324/399

[58] Field of Search ..... 123/479, 481, 630, 198 F; 73/117.3; 324/378, 380, 388, 399

[56] References Cited

U.S. PATENT DOCUMENTS

| | | | |
|---|---|---|---|
| 2,467,732 | 4/1949 | Davis | 123/435 |
| 3,942,102 | 3/1976 | Kuhn et al. | 324/399 |
| 4,024,850 | 5/1977 | Peter | 123/198 F |
| 4,083,234 | 4/1978 | Aono et al. | 60/277 X |
| 4,117,807 | 10/1978 | Barnard | 123/478 |
| 4,452,220 | 6/1984 | Minner | 123/630 X |
| 4,454,560 | 6/1984 | Nakao et al. | 361/257 |
| 4,557,236 | 12/1985 | Showalter | 123/435 |
| 4,684,896 | 8/1987 | Weishaupt | 324/399 |
| 4,886,029 | 12/1989 | Lill et al. | 123/479 |
| 4,918,389 | 4/1990 | Schleupen et al. | 324/399 |

FOREIGN PATENT DOCUMENTS 2463220 5/1985 Fed. Rep. of Germany .

*Primary Examiner*—Tony M. Argenbright
*Attorney, Agent, or Firm*—Michael J. Striker

[57] ABSTRACT

A method of and a device for monitoring combustion in a spark ignition internal combustion engine having a combustion chamber and a discharge system wherein a discharge voltage is monitored for determining whether combustion in the combustion chamber takes place.

7 Claims, 1 Drawing Sheet

METHOD OF AND DEVICE FOR MONITORING COMBUSTION IN A SPARK IGNITION INTERNAL COMBUSTION ENGINE

BACKGROUND OF THE INVENTION

The invention relates to a method of and device for monitoring combustion in an internal combustion engine operable with spark ignition.

If, in an internal combustion engine operable with separate ignition, the introduced fuel is not burnt in the engine combustion chambers, such unburnt fuel becomes purged into the exhaust system. The high temperature prevailing in the exhaust system can cause such fuel to be ignited there, and in particular in an exhausts gas catalyser, which can lead to destruction of the exhaust system.

It has been proposed to monitor the combustion of the fuel/air mixture by measuring the combustion pressure in an engine cylinder. This is not very practical except for research purposes. It has also been proposed to measure ionisation current at the spark plugs. This needs sophisticated equipment.

SUMMARY OF THE INVENTION

The object of the invention is to provide a comparatively simple and reliable method of and a device for monitoring combustion of the ignited fuel/air mixture in an internal combustion engine. The object of the invention is achieved by monitoring an ignition voltage of the spark ignition. The invention is thus based on the evaluation of electrical signals which can be measured at the ignition coil or at the final stage of an ignition control system. The invention employs the phenomenon that the spark discharge voltage characteristic differs according as to whether combustion of the fuel/air mixture introduced into and compressed in the combustion chamber does or does not take place.

By monitoring duration of the discharge voltage it can be determined whether the combustion takes place. The duration of the discharge voltage is longer when combustion takes place than when it does not.

It is a relatively simple matter to monitor the voltage on the primary winding of the ignition coil.

The invention is useful in that it enables the fuel supply to the engine to be temporarily interrupted by monitoring operating parameters of the internal combustion engine. The accumulation of ambient fuel in the exhaust system, and in particular in an exhaust catalyzer can be avoided, thereby reducing the risk of the catalyzer being destroyed or damaged.

BRIEF DESCRIPTION OF THE DRAWINGS

The present invention both as to its construction so to its method of operation, together with additional objects and advantages thereof, will be best understood from the following detailed description of the preferred embodiment with reference to the accompanying drawings.

DESCRIPTION OF THE PREFERRED EMBODIMENT

Figure 1:
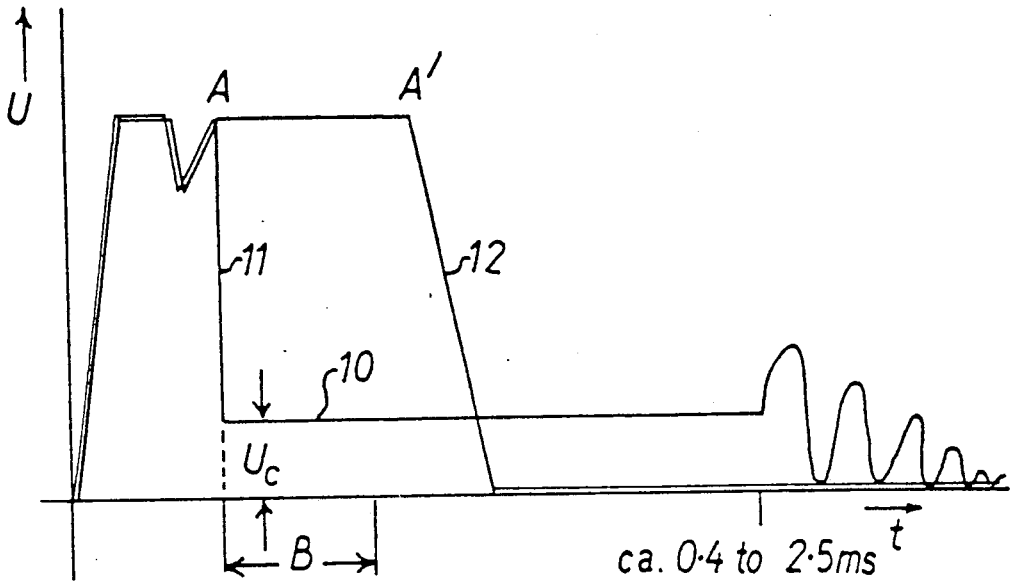
FIG. 1 is a graph of an ignition voltage at the primary winding of an ignition coil, measured with respect to time.

FIG. 1 shows a typical curve 10 for a voltage measured across the primary winding of an ignition coil of a spark-ignited internal combustion engine when the introduced fuel/air mixture is ignited and burns properly. It can be seen that the core voltage $U_c$ follows the falling flank 11 from the peak voltage A for a period of 0.4 to 2.5 ms. Should combustion not take place, the voltage U across the primary winding of the ignition coil falls at the flank 12 to zero from a peak voltage A'. During proper combustion, the discharge voltage $U_c$ and thus the coil voltage lasts for a period significantly longer than a predetermined period B. Thus, the absence of any discharge voltage at the end of the period B following the falling flank indicates that the fuel in the combustion chamber has not burnt.

Figure 2:
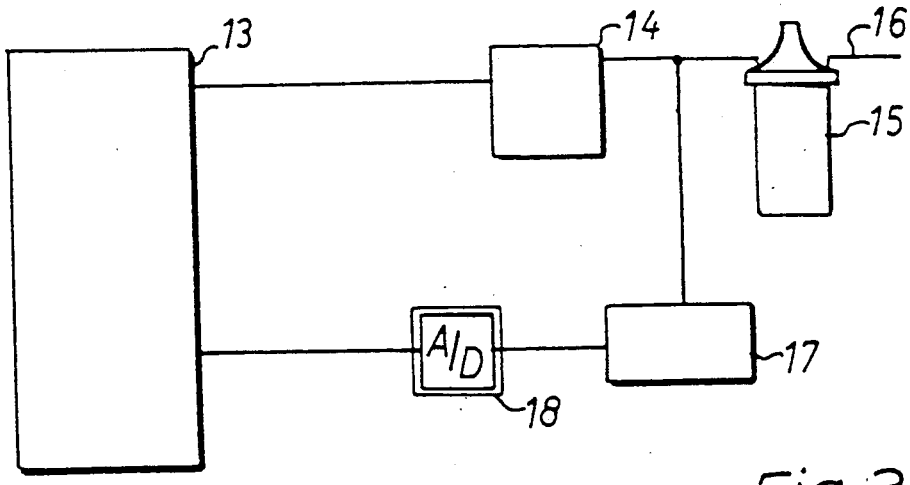
FIG. 2 is a block circuit diagram of a device in accordance with the invention for monitoring a discharge voltage in order to observe the combustion in a spark-ignited internal combustion engine.

In FIG. 2, a microprocessor 13 controls a fuel injection system and a fuel ignition system of an internal combustion engine (not shown). The output of the final stage 14 of the ignition control system (contained mostly within the microprocessor 13) is connected to the primary winding of the ignition coil 15 whose secondary winding is connected to an ignition cable 16 leading to the various spark plugs via an ignition distributor.

The device according to the invention includes a low-pass filter 17 which connects the output of the ignition final stage 14, that is to say, the primary winding of the ignition coil 15, to an analog-to-digital converter which is connected to other parts of the device within the microprocessor 13. The microprocessor detects the falling flank 11 or 12 and checks whether the discharge voltage $U_c$ is still present at the end of the predetermined period B of for example, 0.1 ms after the detected flank. Should no such discharge voltage be detected, the microprocessor 13 ensures that no more fuel is injected prior to the next ignition operation in the respective engine cylinder.

Since the duration of combustion varies in accordance with operating parameters, such as battery voltage, engine speed, load and temperature, it is advantageous to take account of such parameters in the evaluation of the discharge voltage, particularly for cold starting and using the engine as a retarder. Such operating parameters are in any event supplied to the microprocessor 13 for the control of fuel injection and fuel ignition systems.

One advantage of the above evaluation of the ignition voltage is its immediate availability. Another advantage is an evaluation of a signal that originates from the combustion chamber. Also, absence of the discharge voltage outside the combustion chamber can also be detected. Such absence may be due to a disconnected or severed ignition cable or wrongly connected plug leads or due to a faulty distributor.

The immediate response after each ignition operation enables appropriate measures to be taken, e.g. switching off a cylinder. An effective means of protecting the catalyser is thereby possible.

While the invention has been illustrated and described as embodied in a method of and device for observing combustion in a spark ignition internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of monitoring combustion in a spark ignition internal combustion engine having a combustion chamber and a discharge system with an ignition coil having a primary winding, said method comprising the step of monitoring duration of a discharge voltage at the primary winding of the ignition coil and evaluation of the discharge voltage in accordance with operating parameters of the internal combustion engine for determining whether combustion in the combustion chamber takes place.

2. A method as set forth in claim 1, further comprising the steps of generating a control signal in response to the duration of the discharge voltage for a monitored working stroke being less than a predetermined value; and inhibiting injection of fuel into the combustion chamber in response to said control signal for at least one working stroke immediately following the monitored working stroke.

3. A device for monitoring combustion in a spark ignition internal combustion engine having a combustion chamber and a discharge system with an ignition coil having a primary winding, said device comprising means connectable with the discharge system for monitoring the duration of the discharge voltage at said primary winding of the ignition coil for determining whether combustion in the combustion chamber takes place.

4. A device as set forth in claim 3, wherein said monitoring means comprises computer means for monitoring duration of the discharge voltage.

5. A device as set forth in claim 4, wherein said monitoring means includes means for connecting said computer means to the primary winding of the ignition coil.

6. A device as set forth in claim 5, wherein said connecting means includes a low-pass filter connectable with the primary winding of the ignition coil.

7. A device as set forth in claim 6, wherein said connecting means includes an analog-to-digital converter arranged between said low-pass filter and said computer means.

* * * * *